US005598789A

United States Patent [19]

Jonker

[11] Patent Number: 5,598,789

[45] Date of Patent: Feb. 4, 1997

[54] VERTICALLY ADJUSTABLE TABLE

[75] Inventor: Kurt A. Jonker, Grand Rapids, Mich.

[73] Assignee: Knoll, Inc., East Greenville, Pa.

[21] Appl. No.: 599,433

[22] Filed: Jan. 18, 1996

Related U.S. Application Data

[63] Continuation of Ser. No. 213,759, Mar. 15, 1994, abandoned.

[51] Int. Cl.[6] ..... A47B 9/00

[52] U.S. Cl. ..... 108/147; 248/188.5

[58] Field of Search ..... 108/147, 144, 108/10; 149/108.1, 188.2, 188.5

[56] References Cited

U.S. PATENT DOCUMENTS

| | | | |
|---|---|---|---|
| 248,743 | 10/1881 | Hill | 108/147 X |
| 610,933 | 9/1898 | Wagonor | 108/147 X |
| 878,674 | 2/1908 | Samuelson | 108/147 X |
| 3,358,620 | 12/1967 | Parigi . | |
| 3,415,586 | 12/1968 | Hammond | 108/147 X |
| 4,502,394 | 3/1985 | Veyhl . | |
| 4,604,955 | 8/1986 | Fleischer et al. | 108/147 |
| 4,619,208 | 10/1986 | Kurrasch . | |
| 4,627,364 | 12/1986 | Klein et al. | 108/147 |
| 4,751,884 | 6/1988 | Ball . | |
| 4,969,403 | 11/1990 | Schwartz et al. . | |
| 5,083,514 | 1/1992 | Schwartz et al. | 108/144 |
| 5,259,326 | 11/1993 | Borgman et al. | 108/147 |
| 5,289,782 | 3/1994 | Rizzi et al. . | |
| 5,311,827 | 5/1994 | Groone | 108/147 |
| 5,322,025 | 6/1994 | Sherman et al. | 108/147 |
| 5,400,721 | 3/1995 | Greene . | |

FOREIGN PATENT DOCUMENTS

| | | | |
|---|---|---|---|
| 876321 | 5/1953 | Germany | 108/147 |
| 4023768 | 1/1992 | Germany | 108/147 |
| 4026675 | 1/1992 | Germany | 108/147 |
| 8801157 | 12/1989 | Netherlands | 108/147 |
| 4019987 | 9/1994 | WIPO | 108/147 |

*Primary Examiner*—Jose V. Chen

*Attorney, Agent, or Firm*—Buchanan Ingersoll, P.C.; Carla J. Vrsansky

[57] ABSTRACT

Disclosed is a vertically adjustable table or workstation comprising a pair of vertically adjustable leg assemblies, each having a foot member attached to the lower end and a work surface support member attached to the upper end and a planar work surface attached to the tow work surface support members. A substantially horizontal cross beam member extends between the pair of vertically adjustable leg assemblies and contains pulley and cable structure connected to the vertically adjustable leg assemblies which use a conventional extension drawer slide assembly mounted in a vertical position to adjust the vertical height of the work surface.

12 Claims, 5 Drawing Sheets

VERTICALLY ADJUSTABLE TABLE

This application is a continuation of application Ser. No. 08/213,759 filed MAR. 15, 1994, now abandoned.

BACKGROUND OF THE INVENTION

This invention relates to a table or a workstation having a work surface that can be adjusted in vertical height to accommodate the needs and comfort of the user.

The recent widespread use of computer terminals in many offices and industries has led to a number of health and comfort complaints by the workers. Most computer terminals are positioned on conventional non-adjustable desk or work table surfaces and as a result the worker cannot adjust the keyboard or display monitor of the computer terminal to a vertical height that is most convenient and comfortable to the individual worker. Short people must arch their bodies and elevate their arms in order to properly operate the keyboard and view the display monitor. Likewise, tall people must hunch over to properly operate the keyboard and view the display monitor. As a result, conventional non-adjustable desk or work table surfaces for a computer terminal have been uncomfortable for many workers and in some cases have led to health related problems, such as carpal tunnel syndrome of the worker's wrists.

While desks, tables and workstations having a vertically adjustable work surface have been available in the past, they have been generally designed for draftspersons which allow the draftsperson to work in either a sitting or a standing position. Many of the known desks, drafting tables and workstations which were generally designed for draftspersons, were capable of supporting only relatively light loads and were incapable of supporting heavy computer terminals and related equipment. Many of the prior vertically adjustable desks, table and workstations used worm-gear or screw mechanisms to raise and lower the work surface which mechanisms were heavy, expensive and often difficult for the user to operate.

SUMMARY OF THE INVENTION

It is therefore an object of this invention to provide a table or workstation having a vertically adjustable work surface which can be easily adjusted by the user.

It is another object of this invention to provide a table or workstation having a vertically adjustable work surface that is capable of supporting heavy computer terminals and related equipment.

It is a still further object of this invention to provide a table or workstation having a vertically adjustable work surface that is reliable and simple to construct and operate.

It has been discovered that the foregoing objects can be attained by a vertically adjustable table or workstation comprising a pair of vertically adjustable leg assemblies, each having a foot member attached to the lower end and a work surface support member attached to the upper end and a planar work surface attached to the two work surface support members. A substantially horizontal cross beam member extends between the pair of vertically adjustable leg assemblies and contains pulley and cable means connected to the vertically adjustable leg assemblies to adjust the vertical height of the work surface. The vertically adjustable leg assemblies used a conventional heavy duty extension drawer slide assembly mounted in a vertical position to assist the raising and lowering of the work surface of the table.

DESCRIPTION OF THE PREFERRED EMBODIMENTS

Figure 1:
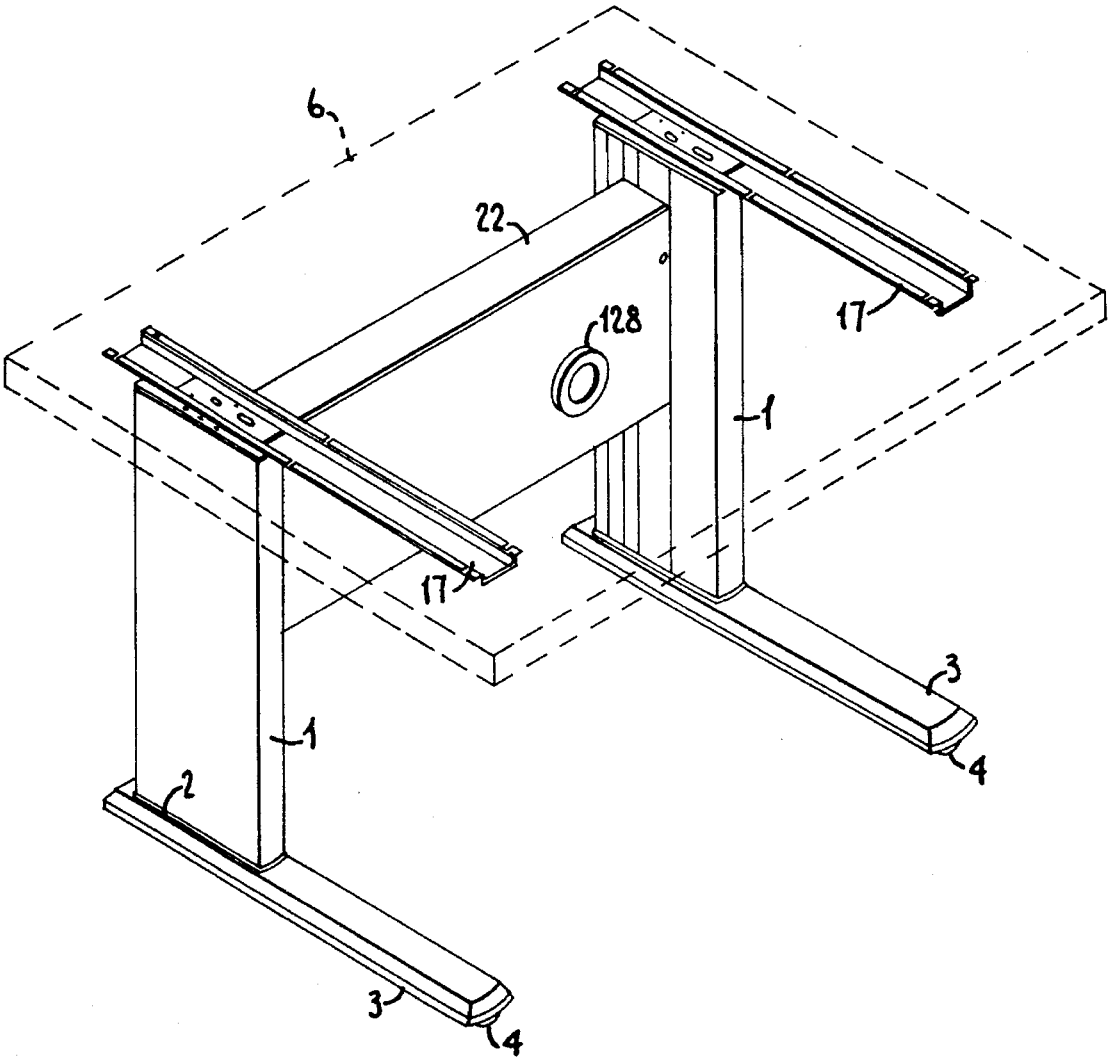
FIG. 1 is an isometric view of the preferred embodiment of the vertically adjustable table or workstation of this invention with the table top or work surface shown in phantom.
Figure 2:
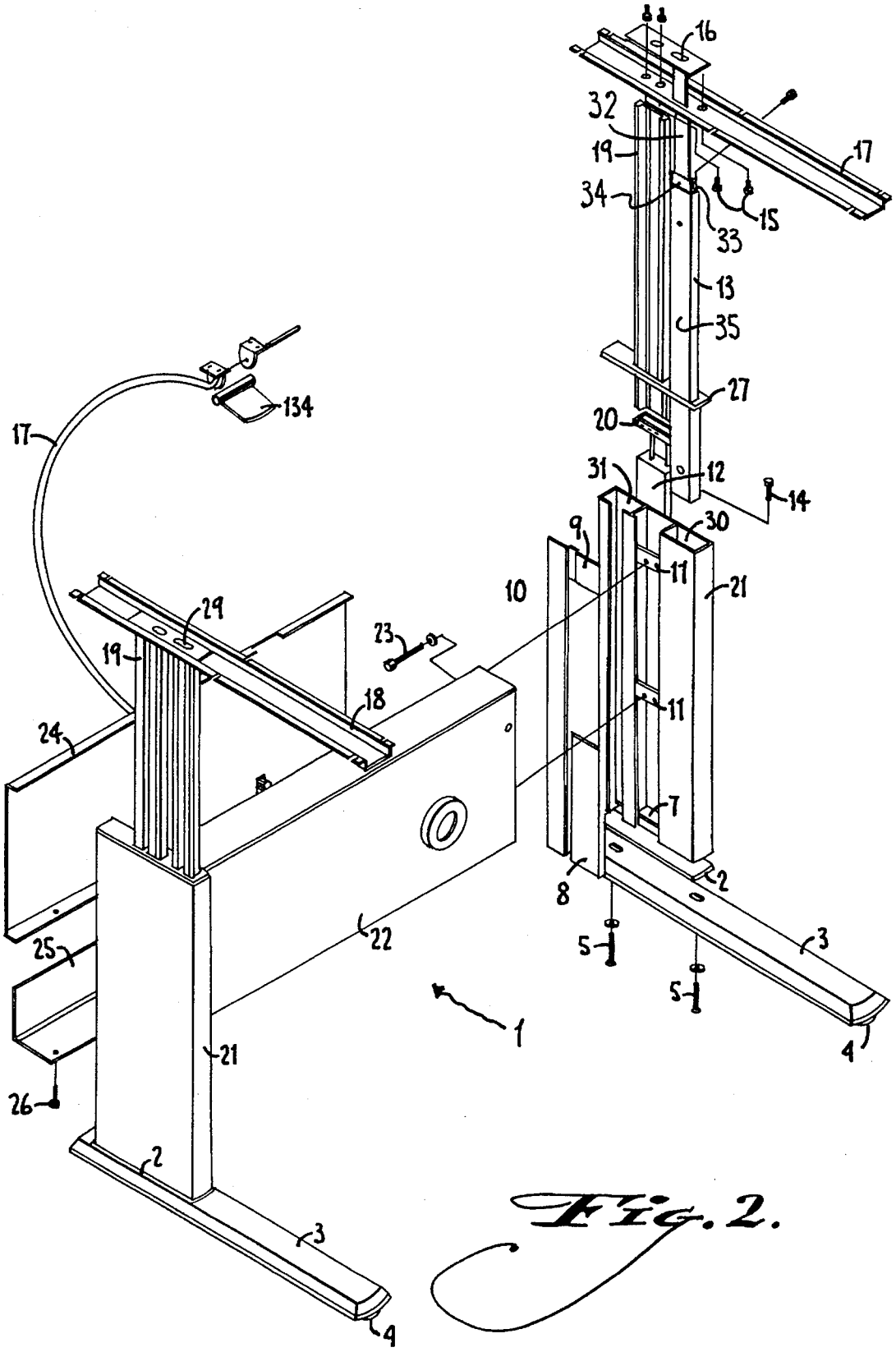
FIG. 2 is an "exploded" view of the preferred embodiment of the vertically adjustable table or workstation of this invention to illustrate the structural components.

FIG. 1 is an isometric view of the preferred embodiment of the vertically adjustable table or workstation of this invention with a planar table top or work surface 6 shown in phantom. Certain features of the adjustable table or workstation of this embodiment have been disclosed in co-pending U.S. patent application Ser. No. 07/900,489, filed Jun. 18, 1992, by H. Peter Greene for "Load Compensator for Spring Counter-Weighting Mechanism." As shown in FIGS. 1 and 2, the table or workstation is comprised of a pair of vertically adjustable leg assemblies 1, each having a foot member 3 attached to the lower end of each leg assembly 1 with a trim ring 2 and screws 5. Threaded levelers 4 are attached to the underside of the front end of each of the foot members 3 to allow the table or workstation to be leveled on an uneven floor. Each leg assembly 1 has a cantilevered work surface support member 17 attached to the upper end of each leg assembly 1 which supports and is attached to the underside of the planar table top or work surface 6.

A substantially horizontal cross beam member 22 extends between and is connected to the pair of vertically adjustable leg assemblies 1 with screws 23 which screw into attachment plates 11 on fixed leg portions 21 of the leg assemblies 1. As shown in FIG. 2, the cross beam member is a substantially hollow box beam made of sheet metal that has a removable back cover plate 24 and bottom trough 25 attached to the cross beam member 22 with sheet metal screws.

Each vertical leg assembly 1 is comprised essentially of a sheet metal fixed leg portion 21 shaped to form an elongated closed slide retention portion 30 and an elongated open channel shaped lift bar retention portion 31. As shown in FIG. 2, a trim ring 2, a stop block 7 and the attachment plates 11 connect the closed slide retention portion 30 and the open channel shaped lift bar retention portion together in a spaced parallel relationship to each other within the fixed leg portion 21 of each leg assembly 1. A top trim cap 27, with openings for a channel shaped lift bar 19 and a slide assembly 31, closes off the top of the fixed leg portion 21 of each leg assembly 1. The channel shaped lift bar 19 slidably fits and is retained within the channel shaped lift bar retention portion 31 of the fixed leg portion of each leg assembly 1.

A heavy duty drawer slide assembly 13 comprised of an inner channel member 32 that rolls on bell bearings 33 held in a bearing retainer 34 along the inner surface of an outer channel member 35 fits and is retained within the closed slide retention portion 30 of the fixed leg portion 21 of each leg assembly 1 by screws 14 and 15. The heavy duty drawer slide assembly 13 used in this embodiment was a standard heavy duty drawer slide, Model ULFHD 584/381 drawer slide assembly manufactured by Thomas Regout U.S.A., that is normally mounted horizontally in a cabinet and used to support and guide horizontally opening drawers in a file cabinet or the like. The vertical use of the slide assembly in a vertically adjustable table is unique and provides a smoother and more effective form of an adjustable vertical support for the work surface. The use of the slide assembly 13 is a less expensive means of guidance than conventional prior art rack and pinion or roller guide systems. In addition the slide assembly 13 can be supported by a flat wire cable support which not only strengthens the slide connection, but also helps to eliminate side-to-side racking in the table and also increases the strength of the leg assemblies in cantilever loading system tables. A further benefit of using a drawer slide assembly 13 that rolls on ball bearings, 33 is a significant reduction in noise usually associated with the raising and lowering of prior art tables.

The top of the slide assembly 13 and the lift bar 19 are both attached to the cantilever work surface support member 17 by a plate 16 and screws 5 and 15. The bottom of the lift bar 19 is attached to a bottom bearing plug 20 with screws 14 and is also provided with an upper bearing 12 which allow the lift bar 19 to slide vertically within the channel shaped lift bar retention portion 31 of the leg assembly 1 and hold the lift bar 19 in vertical alignment throughout such vertical movement within each leg assembly 1. Inner leg covers 8 and 9 and a leg flap 10 close off the inner face of each fixed leg portion 21 of the leg assemblies 1 and allow an opening therein for the connection of the ends of the cross beam member 22 to the fixed leg portions 21 of the two leg assemblies i with screw 23 which screw into the attachment plates 11 of the leg assemblies 1.

Figure 3:
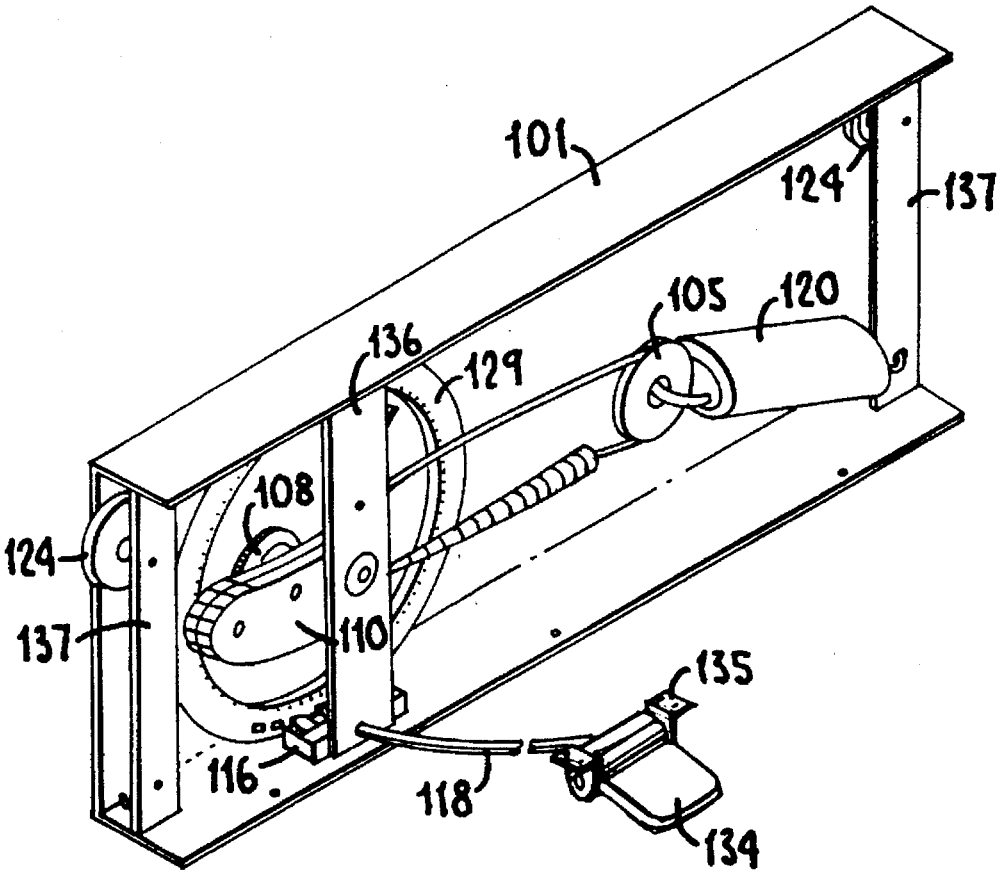
FIG. 3 is an isometric view of the preferred embodiment of the mechanism used to raise and lower the vertically adjustable table or workstation of this invention.
Figure 4:
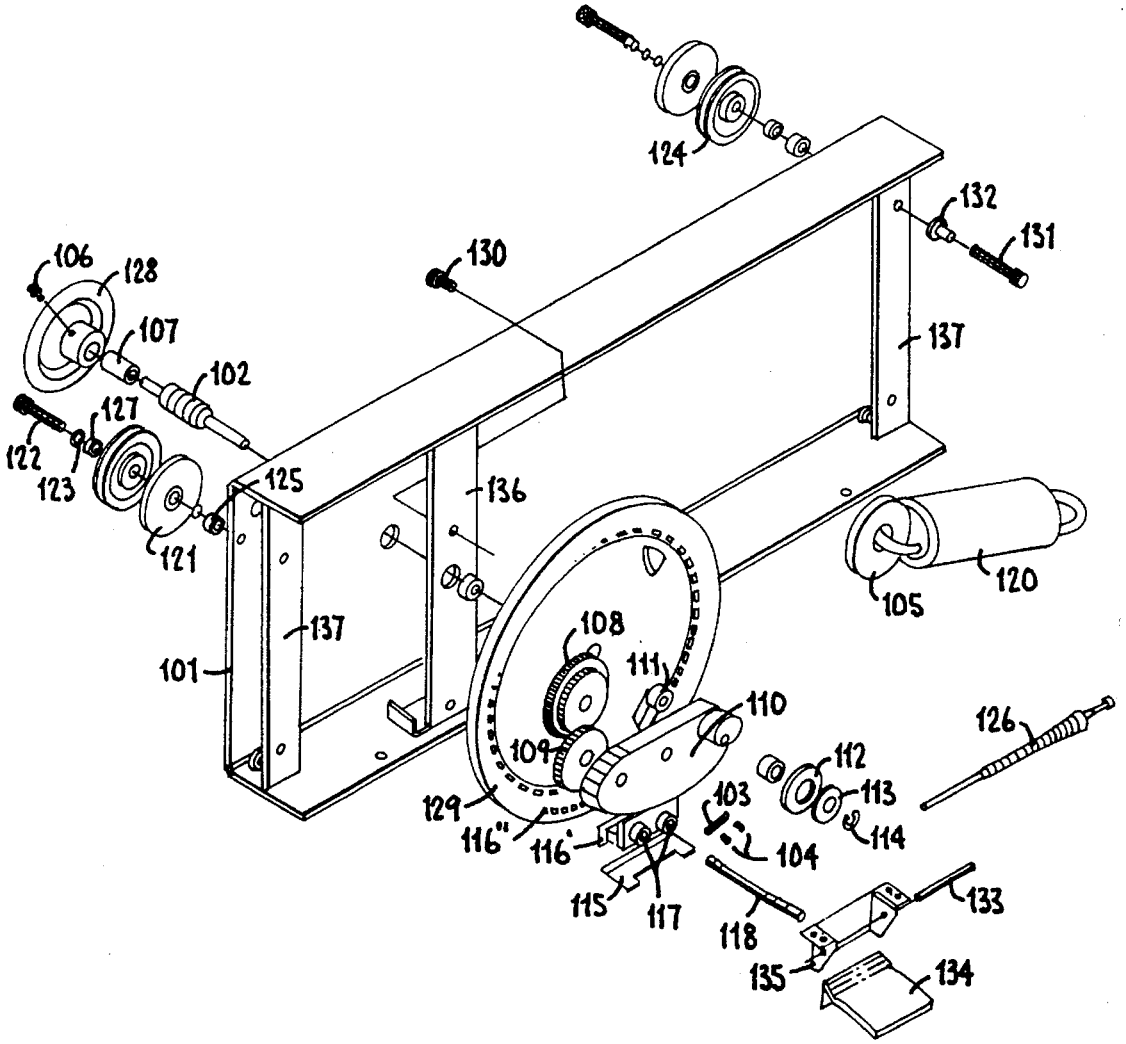
FIG. 4 is an "exploded" view of the mechanism shown in FIG. 3 to illustrate the components.

As shown in FIGS. 3–6, the cross beam member 22 contains the mechanism used to raise and lower the vertically adjustable table or workstation of this invention. As best illustrated in FIG. 4, the interior of the substantially hollow cross beam member 22 is provided with a main axle or shaft 102 fitted with a geared sleeve 102' and attached at one of its ends to a height adjustment control knob 128 with a bushing 107 and a set screw 106. The other end of the main axle or shaft 102 passes through an opening in the cross beam 22 and a bearing 111 mounted therein. The main axle or shaft 102 then extends through a central opening in a large pulley 129, a bearing 111, an opening in spiral member 110, another bearing 111 mounted in a vertical support member 136 welded to the cross beam 22 and is secured in place with washers 112 and 113 and a retaining clip 114.

As also shown in FIGS. 3 and 4, the upper corner at each end of the cross beam member 22 is fitted with a small axle 122, a small guide pulley 124, a small load pulley 121, spacer 123, 125 and 127 and secured to vertical support members 137 welded to the cross beam member 22.

Figure 5:
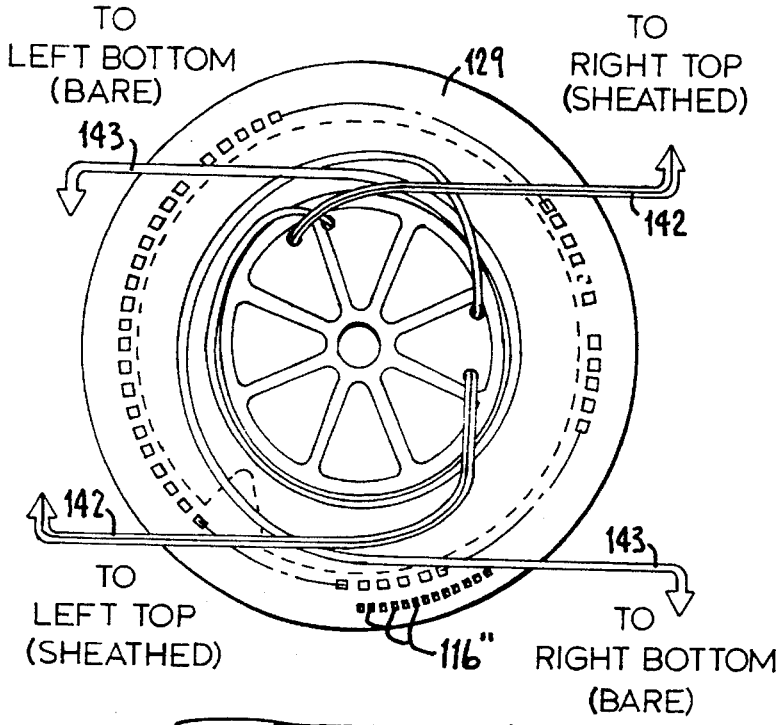
FIG. 5 is an elevation view of the pulley and cable assembly used to raise and lower the vertically adjustable table or workstation of this invention.
Figure 6:
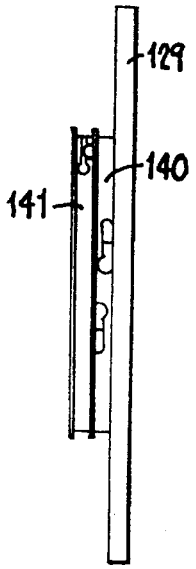
FIG. 6 is a side view of the pulley and cable assembly used to raise and lower the vertically adjustable table or workstation of this invention.

As shown in FIGS. 5 and 6, the large pulley 129 is provided with a pair of similar sheaves 140 and 141. Each of the sheaves 140 and 141 is provided with a cable 142 or 143 which are wound on the respective sheave and then have the ends of each cable attached to either the left or right lift bar 19. As illustrated in FIG. 5, one end of one of sheathed cable 142 is attached to the top portion of the right hand lift bar 19 and the other end of cable 142 is attached to the top of the left hand lift bar 19. One end of the bare cable 143 wound on the other sheave is attached to the bottom portion of the right hand lift bar 19 and the other end of the cable 143 is attached to the bottom of the left hand lift bar 19. As one of the cables 142 or 143 is wound from one of the sheaves 140 or 141 the other cable is unwound from the other sheave providing a completely cable controlled upward or downward movement of the two lift bars to raise or lower the table top 6.

As best illustrated in FIGS. 3 and 4, the large pulley 129 is fitted with a brake or locking mechanism operated by the user with a paddle type lever 134, pivotally mounted in a bracket 135 by a pivot pin 133 and attached to the underside of the table top 6. A slidable wire cable 118 attached at one end to the paddle type lever 134 extends to a slider plate 115 having a brake block 116 and mounted with a pair of compression springs 117 between guides extending behind the vertical support member 36 and adjacent the large pulley 129. The brake block 116 is provided with teeth 116' which, under pressure from the compression springs 117, will engage closely spaced openings 116" in a portion of the outer periphery of the large pulley when the paddle type lever is released by the user and thereby locks the large pulley 129 in a fixed position. Movement of the paddle type lever 134 by the user causes the slider plate and brake block 116 to move away from the large pulley compressing the compression springs 117 and unlocks the teeth 116' from the closely spaced openings 116" on the large pulley 129 and allows the large pulley to be rotated to a new position.

The large pulley 129 is also provided with a spiral member 110 which is attached to gear 109 that engages gears 108. The spiral member 110 has a cable 126 that fits into a groove in the spiral member 110 and around a pulley 105 attached to an extension spring 120 attached to the cross beam assembly 22 as best illustrated in FIG. 3. This arrangement provides a suitable amount of tension on the gear assembly associated with the large pulley 129 to allow a smooth rotation of the gears.

To raise or lower the table top 6, the user merely lifts the paddle type lever 134 to release the brake on the large pulley 129 and then rotates the control knob 128 that will manually rotate the large pulley 129 and the cables 142 and 143 and in turn raise or lower the lift bars 19 and the table top 6 to the desired position. The paddle lever 134 is then released and the table top 6 is locked in the new position.

The use of the drawer slide assemblies 13 along side the lift bars 19 permits smooth and sturdy support for the table top during the raising and lowering operation. While drawer slides have been used horizontally the use of them in a vertical position in a vertically adjustable table is believed unique.

It is to be understood that this embodiment is just one example of a vertically adjustable table or workstation of this invention and is provided for purposes of illustrating and describing this invention and not for purposes of limitation.

I claim:

1. A vertically adjustable workstation comprising:

a pair of vertically adjustable leg assemblies each having a foot member attached to the lower end and a work surface support member attached to the upper end and a fixed leg portion extending between the foot member and the work surface support member, each fixed leg portion including a closed portion and an open channel portion;

a work surface attached to the work surface support members;

a vertically mounted extension drawer slide assembly housed in one of the closed portion and the open channel portion of each fixed leg portion for assisting in raising and lowering the work surface, each drawer slide assembly comprising an outer channel member and an inner channel member;

a lift bar housed in the other of the closed portion and the open channel portion of each fixed leg portion; and means connected to the leg assemblies for adjusting the vertical height of the work surface.

2. The vertically adjustable workstation according to claim 1 wherein the inner channel member of each drawer slide assembly is housed in a bearing retainer having ball bearings.

3. The vertically adjustable workstation according to claim 7 wherein the bearing retainer is housed in the outer channel member of each drawer slide assembly.

4. The vertically adjustable workstation according to claim 3 wherein the outer channel of each drawer slide assembly is retained in the closed portion of each leg assembly.

5. The vertically adjustable workstation according to claim 4 wherein the lift bar is housed in the open channel portion of each leg assembly.

6. The vertically adjustable workstation according to claim 5 wherein the top of the drawer slide assembly and the top of the lift bar are attached to the work surface support member.

7. The vertically adjustable workstation according to claim 6 wherein the means for adjusting the vertical height of the work surface is housed in a cross beam member.

8. The vertically adjustable workstation according to claim 7 wherein the means for adjusting the vertical height of the work surface is a pulley and cable system.

9. A vertically adjustable workstation comprising:

a pair of vertically adjustable leg assemblies each having a foot member attached to a lower end, a work surface support member attached to an upper end and a vertically adjustable lift bar;

a work surface attached to the work surface support members;

a vertically mounted extension drawer slide assembly extending between the foot member and the work surface support member of each leg assembly, each drawer slide assembly comprising an outer channel member and an inner channel member separated by ball bearings; and means connected to the vertically adjustable leg assemblies for adjusting the vertical height of the work surface.

10. The vertically adjustable workstation according to claim 9 wherein the means for adjusting the vertical height of the work surface is a pulley and cable system.

11. A vertically adjustable workstation comprising:

a pair of vertically adjustable leg assemblies each having a foot member attached to a lower end, a work surface support member attached to an upper end and a vertically adjustable lift bar;

a planar work surface attached to the work surface support members;

a vertically mounted extension drawer slide assembly extending between the foot member and the work surface support member of each leg assembly, each drawer slide assembly comprising an outer channel member and an inner channel member separated by ball bearings; and a substantially horizontal cross beam member extending between the pair of vertically adjustable leg assemblies, the cross beam member containing means connected to the vertically adjustable leg assemblies for adjusting the vertical height of the work surface.

12. The vertically adjustable workstation according to claim 11 wherein the means for adjusting the vertical height of the work surface is a pulley and cable system.

* * * * *